US007038150B1

(12) United States Patent
Polosky et al.

(10) Patent No.: US 7,038,150 B1
(45) Date of Patent: May 2, 2006

(54) MICRO ENVIRONMENTAL SENSING DEVICE

(75) Inventors: Marc A. Polosky, Tijeras, NM (US); Laurance L. Lukens, Tijeras, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 10/886,142

(22) Filed: Jul. 6, 2004

(51) Int. Cl.
*H01H 35/02* (2006.01)

(52) U.S. Cl. ..... 200/61.45 R; 200/61.45 M

(58) Field of Classification Search ..... 200/61.49, 200/61.53, 61.45 R–61.45 M; 73/514.01, 73/514.16, 488, 514.21–514.24, 514.31, 73/514.34–514.36, 514.38
See application file for complete search history.

(56) References Cited

U.S. PATENT DOCUMENTS 3,022,393 A * 2/1962 Weaver ..... 200/61.45 R
3,132,220 A * 5/1964 Uri et al. ..... 200/61.45 R
4,280,355 A 7/1981 Donnally et al.
4,414,901 A 11/1983 Sellwood
4,448,106 A 5/1984 Knapp
4,603,635 A 8/1986 Boudreau
4,777,656 A 10/1988 Wade
4,855,544 A * 8/1989 Glenn ..... 200/61.45 R
4,882,933 A * 11/1989 Petersen et al. ..... 73/514.13
5,092,172 A 3/1992 Overman et al.
5,317,914 A 6/1994 Franco, Jr.
5,335,749 A 8/1994 Taguchi et al.
5,501,893 A 3/1996 Laermer et al.
5,540,095 A 7/1996 Sherman et al.
5,781,869 A 7/1998 Parlett, Jr. et al.
5,828,138 A * 10/1998 McIver et al. ..... 307/10.1
5,962,789 A * 10/1999 Matsunaga et al. ..... 73/514.38
5,966,066 A * 10/1999 Mehregany et al. ..... 337/70
5,987,988 A * 11/1999 Kunimi et al. ..... 73/514.01
5,990,427 A * 11/1999 Lammert et al. ..... 200/61.53
6,080,944 A * 6/2000 Itoigawa et al. ..... 200/61.45 R (Continued)

FOREIGN PATENT DOCUMENTS

EP 466021 A2 * 1/1992

(Continued)

*Primary Examiner*—Michael Friedhofer
*Assistant Examiner*—Lisa Klaus
(74) *Attorney, Agent, or Firm*—John P. Hohimer

(57) ABSTRACT

A microelectromechanical (MEM) acceleration switch is disclosed which includes a proof mass flexibly connected to a substrate, with the proof mass being moveable in a direction substantially perpendicular to the substrate in response to a sensed acceleration. An electrode on the proof mass contacts one or more electrodes located below the proof mass to provide a switch closure in response to the sensed acceleration. Electrical latching of the switch in the closed position is possible with an optional latching electrode. The MEM acceleration switch, which has applications for use as an environmental sensing device, can be fabricated using micromachining.

35 Claims, 12 Drawing Sheets

U.S. PATENT DOCUMENTS 6,104,073 A * 8/2000 Ferrari et al. ..... 257/417
6,199,430 B1 * 3/2001 Kano et al. ..... 73/514.32
6,236,005 B1 * 5/2001 Kvisteroey et al. ... 200/61.45 R
6,314,887 B1 11/2001 Robinson
6,321,654 B1 11/2001 Robinson
6,327,909 B1 * 12/2001 Hung et al. ..... 73/514.16
6,332,400 B1 12/2001 Meyer
6,336,658 B1 * 1/2002 Itoigawa et al. ..... 280/735
6,349,652 B1 2/2002 Hepner et al.
6,378,437 B1 4/2002 Burke, Jr. et al.
6,393,913 B1 * 5/2002 Dyck et al. ..... 73/504.12
6,401,621 B1 6/2002 Davis et al.
6,470,805 B1 10/2002 Woodall et al.
6,586,691 B1 * 7/2003 Itoigawa et al. ..... 200/61.49
6,619,123 B1 9/2003 Gianchandani
6,635,837 B1 * 10/2003 Subramanian et al. ..... 200/181
6,729,240 B1 5/2004 Smith et al.
6,765,160 B1 * 7/2004 Robinson ..... 200/61.45 R
6,797,899 B1 * 9/2004 Itoigawa et al. ..... 200/61.48
6,845,670 B1 * 1/2005 McNeil et al. ..... 73/514.32

FOREIGN PATENT DOCUMENTS

WO WO 8808613 A1 * 11/1988

* cited by examiner

MICRO ENVIRONMENTAL SENSING DEVICE

GOVERNMENT RIGHTS

This invention was made with Government support under Contract No. DE-AC04-94AL85000 awarded by the U.S. Department of Energy. The Government has certain rights in the invention.

FIELD OF THE INVENTION

The present invention relates in general to microelectromechanical (MEM) devices, and in particular to a MEM acceleration switch for sensing when a particular level of acceleration or deceleration has occurred.

BACKGROUND OF THE INVENTION

Acceleration switches can be used whenever a particular level of acceleration or deceleration must be sensed. For example, in automobiles, an acceleration switch can be used to sense a crash and trigger the deployment of an airbag, or to sense or a severe braking situation and trigger a seat belt tensioning device.

The present invention represents an advance in the art of acceleration switches by providing an acceleration switch that can be formed by micromachining. This minimizes a need for conventional precision machining and piece-part assembly.

The acceleration switch of the present invention can be formed using batch fabrication techniques, with individual devices having acceleration set points which can be selected over a wide range from 1 G to one thousand G or more, where G is the acceleration due to gravity.

These and other advantages of the present invention will become evident to those skilled in the art.

SUMMARY OF THE INVENTION

The present invention relates to a microelectromechanical (MEM) acceleration switch which comprises a substrate; a proof mass flexibly connected to the substrate by a plurality of folded springs located around a periphery of the proof mass, with the proof mass being moveable in a direction substantially perpendicular to the substrate in response to a sensed acceleration, and further comprising a first electrode located on a major surface of the proof mass; and a second electrode located proximate to the first electrode to provide an electrical connection thereto upon movement of the first electrode into contact with the second electrode in response to the sensed acceleration. The MEM acceleration switch can further comprise an electrical latch to maintain the electrical connection between the first and second electrodes after the sensed acceleration has occurred.

The substrate and the proof mass can each comprise silicon. Each folded spring can also comprise silicon, which can be either monocrystalline silicon when a silicon-on-insulator substrate is used, or polycrystalline silicon when a silicon substrate is used.

The thickness of the proof mass can be greater than or equal to the thickness of the substrate; and each folded spring can have a thickness in the range of 1–50 microns, for example, with the exact thickness of each spring depending upon a threshold value of the acceleration which is to be sensed by the MEM acceleration switch. The major surface of the proof mass can have a shape that is generally either circular or polygonal. The number of folded springs can comprise, for example, three to sixteen folded springs. Each folded spring can further comprise a first pair of spring arms connected to the proof mass, and a second pair of spring arms connected to the substrate, with the first and second pairs of spring arms being connected together by a cross-beam. One or more stops can be optionally provided on the substrate extending over the periphery of the proof mass to limit movement of the proof mass in a direction away from the second electrode.

The second electrode in the MEM acceleration switch can be located on a submount whereon the substrate is attached, or alternately can comprise a pin of a package whereon the substrate is attached. Yet another electrode (i.e. a third electrode) can be located on the submount or in the package. In this case, the first electrode can contact the second and third electrodes as the proof mass is moved in response to the sensed acceleration and thereby provide an electrical connection (i.e. a switch closure) between the second and third electrodes via the first electrode, or from the first electrode to the second and third electrodes. The first electrode can be electrically connected to the substrate through the proof mass and the plurality of folded springs.

The present invention further relates to a MEM acceleration switch which comprises a substrate; a proof mass flexibly anchored to the substrate by a plurality of folded springs located around a periphery of the proof mass, with the proof mass being moveable in a direction substantially perpendicular the substrate, and with the proof mass having a metallization covering at least a portion of a major surface thereof; and at least one electrode located proximate to the metallization to form an electrical contact therewith upon movement of the proof mass in response to an acceleration event above a threshold value. An electrical latch can optionally be included in the MEM acceleration switch to maintain the electrical contact after occurrence of the acceleration event.

The substrate and the proof mass can each comprise silicon. The major surface of the proof mass can have a shape that is circular or polygonal. One or more of the electrodes can be located on a submount or package whereon the substrate is attached.

The plurality of folded springs generally comprises three to sixteen folded springs, with each folded spring having a thickness, for example, in the range of 1–50 microns (μm). Each folded spring comprises a first pair of spring arms connected to the proof mass, and a second pair of spring arms connected to the substrate, with the first and second pairs of spring arms being connected together by a cross-beam.

The present invention also relates to a MEM acceleration switch which comprises a substrate; a proof mass formed, at least in part from the substrate, with the proof mass being attached to the substrate by three to sixteen springs located around a periphery of the proof mass, and with the proof mass having a metallization covering a majority of a major surface thereof and forming a first electrode; and a second electrode located beneath the proof mass, with the first and second electrodes being spaced apart when the proof mass is in a rest position, and with the first and second electrodes being electrically connected together when the proof mass is urged into contact with the second electrode in response to an acceleration event directed substantially perpendicular to a plane of the substrate and above a threshold value. The MEM acceleration switch can further comprise an electrical latch to maintain an electrical connection between the first and second electrodes after occurrence of the acceleration event.

The substrate can comprise silicon. Each spring can comprise a folded spring or an arcuate spring, and can have a thickness in the range of 1–50 μm, for example. The proof mass can have a circular or polygonal shape. An optional third electrode can be located beneath the proof mass, with the third electrode being spaced apart from the first and second electrodes when the proof mass is in the rest position, and with the third electrode being electrically connected to the first and second electrodes when the proof mass is urged into contact with the second and third electrodes in response to the acceleration event directed substantially perpendicular to a plane of the substrate and above the threshold value. The second and third electrodes can be located on a submount or package whereon the substrate is attached.

The present invention further relates to a MEM acceleration switch which comprises a substrate; a proof mass formed at least in part from the substrate and attached to the substrate by a plurality of arcuate springs located around a periphery of the proof mass, with the proof mass forming a first electrode; and a second electrode located beneath the proof mass. The first and second electrodes are spaced apart when the proof mass is in a rest position, and are electrically connected together when the proof mass is urged into contact with the second electrode in response to an acceleration event that directed substantially perpendicular to a plane of the substrate and above a threshold value. The MEM acceleration switch can further comprise an electrical latch to maintain an electrical connection between the first and second electrodes after occurrence of the acceleration event. The MEM acceleration switch can also comprise a plurality of lateral stops to limit movement of the proof mass in the plane of the substrate.

Additional advantages and novel features of the invention will become apparent to those skilled in the art upon examination of the following detailed description thereof when considered in conjunction with the accompanying drawings. The advantages of the invention can be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several aspects of the present invention and, together with the description, serve to explain the principles of the invention. The drawings are only for the purpose of illustrating preferred embodiments of the invention and are not to be construed as limiting the invention. In the drawings.

DETAILED DESCRIPTION OF THE INVENTION

Figure 1:
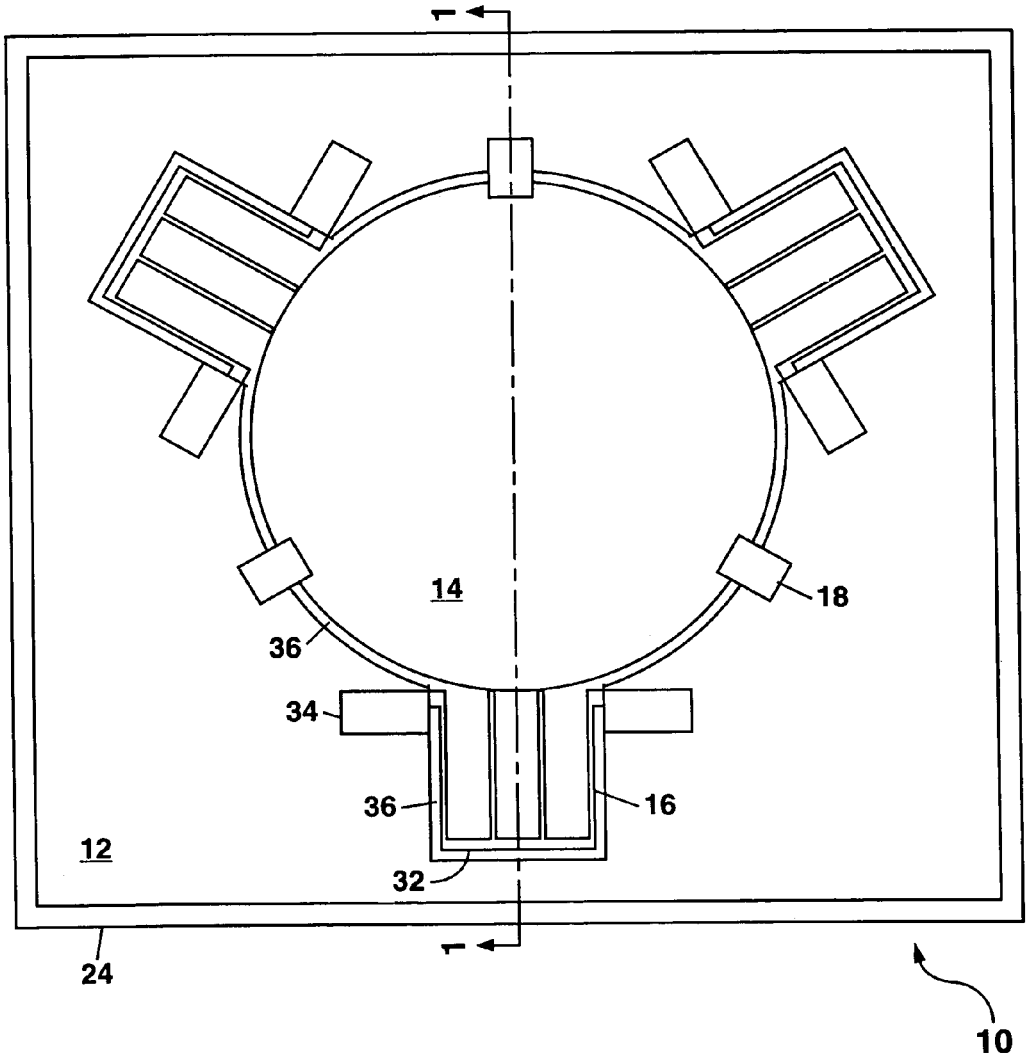
FIG. 1 shows a schematic plan view of a first example of the MEM acceleration switch of the present invention.

Referring to FIG. 1, there is shown a schematic plan view of a first example of a microelectromechanical (MEM) acceleration switch 10. The MEM acceleration switch 10 in FIG. 1 comprises a substrate 12, with a proof mass 14 being suspended from the substrate 12 by a plurality of folded springs 16 so that the proof mass 14 is flexibly connected (i.e. anchored) to the substrate 12 and can move in a direction that is substantially perpendicular to the substrate 12 (i.e. substantially perpendicular to a plane formed by a major surface of the substrate 12) in response to a sensed acceleration (also termed herein an acceleration event, or an acceleration component). The term "folded spring" as used herein refers to a spring which comprises a plurality of spring arms arranged in juxtaposition, with each adjacent pair of the spring arms being connected together.

A plurality of stops 18 are also provided on the substrate 12 in the MEM acceleration switch 10 of FIG. 1 to limit movement of the proof mass 14 in an upward direction (i.e. out of the page of FIG. 1) so that any substantial motion of the proof mass 14 will be in a downward direction (i.e. into the page of FIG. 1). Such downward motion of the proof mass 14 will occur in response to an upward-directed acceleration component to which the MEM acceleration switch 10 is responsive.

Figure 2A:
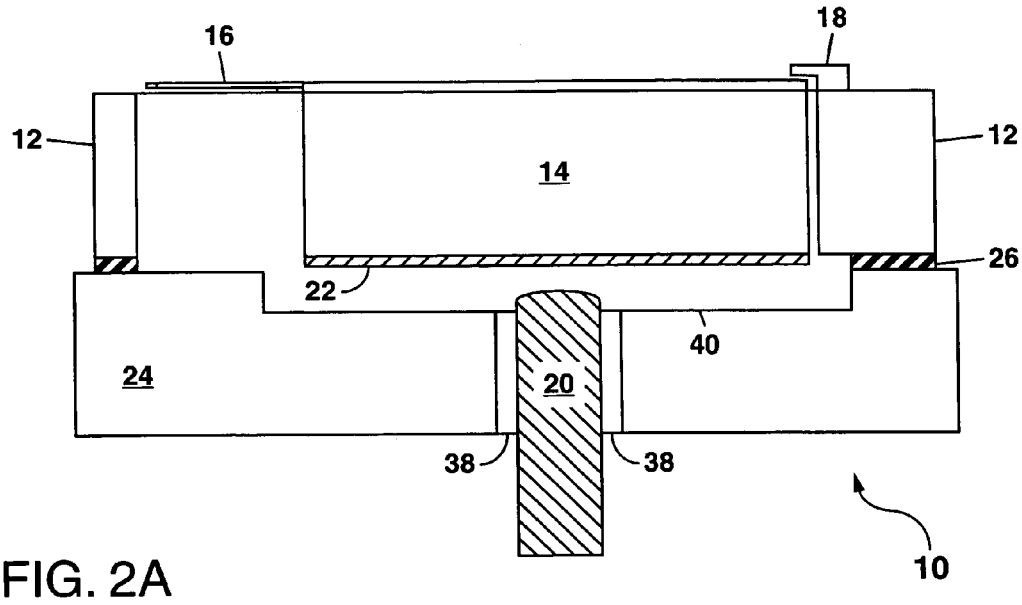
FIGS. 2A and 2B show schematic cross-section views of the device of FIG. 1 along the section line 1—1 in FIG. 1, with the device being in a rest position (i.e. an open position) in FIG. 2A and in an actuated position (i.e. a closed position) in FIG. 2B.
Figure 2B:
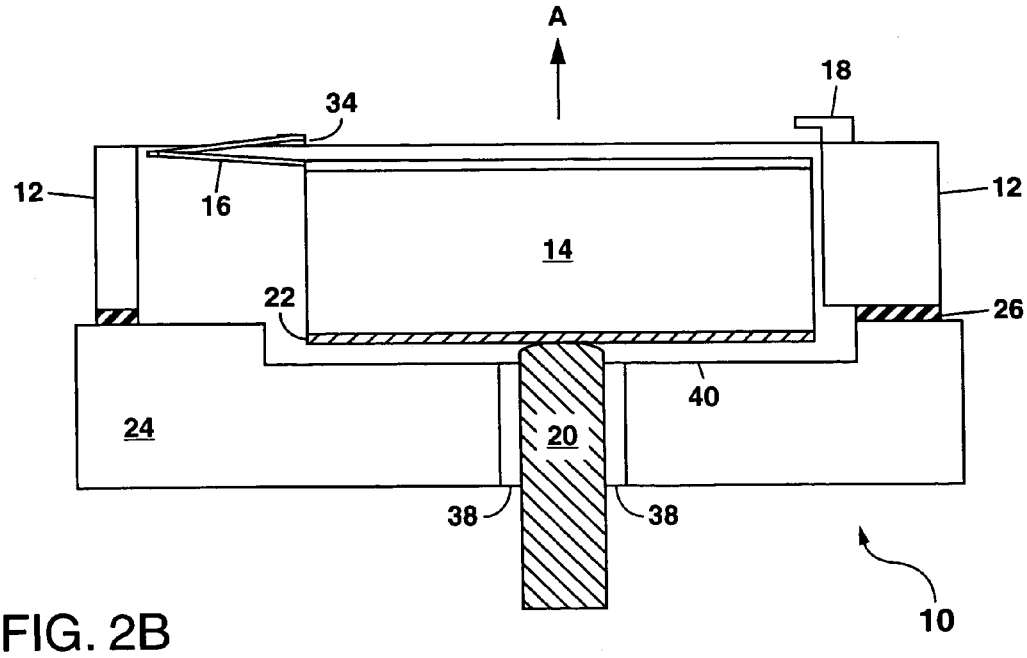

FIGS. 2A and 2B show schematic cross-section views of the device 10 of FIG. 1 along the section line 1—1 in FIG. 1 to illustrate operation of the MEM acceleration switch 10. In FIG. 2A, the device 10 is shown in a rest position without any applied acceleration component. This is the position in which the MEM acceleration switch 10 is fabricated. In the rest position, the proof mass 14 is suspended from the substrate 12 by a plurality of folded springs 16 so that there is no contact between the proof mass 14 and an underlying electrode 20.

In FIG. 2B, in response to an upward-directed acceleration component A indicated by the arrow, the proof mass 14 is urged to move in the opposite direction, and will contact the electrode 20 when the acceleration component A exceeds a predetermined threshold value determined by the mass of the proof mass 14 and the stiffness of the springs 16. In the example of FIGS. 1 and 2A, 2B, a metallization 22 is provided on an underside major surface of the proof mass 14 to form an electrode for the proof mass 14 which can be electrically connected through the springs 16 to the substrate 12. The metallization 22, which covers a portion and preferably a majority of the underside major surface of the proof mass 14, can thus form a relatively low-resistance (e.g. less than a few hundred Ohms, and preferably about 50 Ohms) electrical connection between the proof mass 14 and the electrode 20 when the metallization 22 is urged into contact with the electrode 20 in response to a sensed acceleration above the threshold value.

In the example of the MEM acceleration switch 10 shown in FIGS. 1 and 2A, 2B, the substrate 12 with suspended proof mass 14 can be attached to a submount or package 24 wherein one or more electrodes 20 are located. The form of attachment can be using a bonding material 26 such as an adhesive (e.g. epoxy) or solder, or alternately by directly bonding the substrate 12 to the submount or package 24 (e.g. using an anodic wafer bonding process or a low-temperature co-fired ceramic packaging process as known to the art). Those skilled in the art will understand that there are many different ways to attach the substrate 12 to a submount or package 24.

The package 24 can comprise a conventional semiconductor device package such as a TO-5 or TO-18 header which can be sealed with a cover (not shown) to form a hermetically-sealed MEM acceleration switch 10. Alternately, the package 24 can be a custom-designed package such as a hermetically-sealed low-temperature co-fired ceramic (LTCC) package. Additional electronic circuitry can be optionally included in a package 24 for the MEM acceleration switch 10 either adjacent to the switch 10 or formed on the substrate 12 when the substrate comprises silicon. This circuitry, which can comprise a semiconductor integrated circuit as known to the art, can be used, for example, to condition an electrical signal produced by activation of the switch 10, or to provide a trigger signal upon a closure of the switch 10 upon sensing a predetermined acceleration event (i.e. an acceleration component A above the threshold level).

Fabrication of the MEM acceleration switch 10 of FIGS. 1 and 2A, 2B will now be described with reference to FIGS. 3A–3I. Although the fabrication will be described in terms of micromachining based on semiconductor processing steps including material deposition and etching, those skilled in the art will understand that fabrication of the switch 10 of the present invention can also be performed using LIGA (an acronym based on the first letters for the German words for lithography, electroplating and injection molding).

Figure 3A:
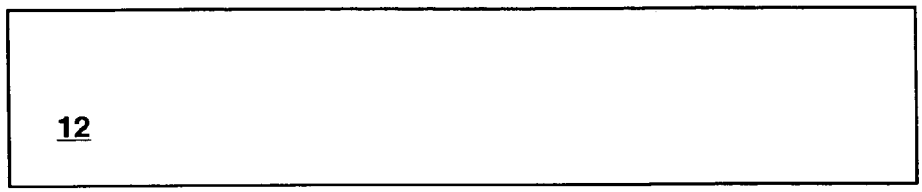
FIGS. 3A–3I show schematic cross-section views to illustrate fabrication of the device of FIG. 1.

In FIG. 3A, a substrate 12 is provided which can be, for example, a monocrystalline silicon substrate. The silicon substrate 12 is preferably doped throughout for electrical conductivity (e.g. to about $10^{18}$ $cm^{-3}$).

Figure 3B:
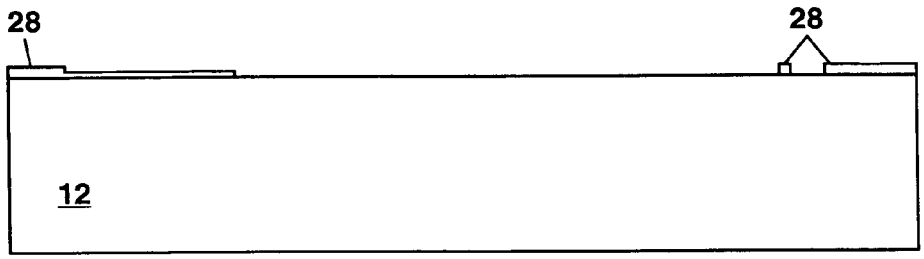

In FIG. 3B, a layer of a sacrificial material 28 (e.g. silicon dioxide or a silicate glass such as TEOS which can be deposited from the decomposition of tetraethylortho silicate by low-pressure chemical vapor deposition at about 750° C. and densified by a subsequent high temperature processing step) can be blanket deposited over the silicon substrate 12 and patterned by reactive ion etching. This patterning, done using a photolithographically-defined etch mask which is not shown in FIG. 3B, removes portions of the sacrificial material 28 to form a mold for a subsequent deposition of one or more layers of polycrystalline silicon (also termed polysilicon) which will be used to form the springs 16 and the stops 18 by surface micromachining.

Those skilled in the art will understand that the references to "patterning" and "patterned" herein refer to a series of process steps which are well-known in the semiconductor device fabrication art including applying a photoresist to the substrate 12, prebaking the photoresist, aligning the substrate 12 with a photomask, exposing the photoresist through the photomask, developing the photoresist, baking the photoresist, etching away the surfaces not protected by the photoresist, and stripping the protected areas of the photoresist so that further processing can take place. The term "patterning" can further include the formation of a hard mask (e.g. comprising about 500 nanometers of TEOS) overlying a polysilicon or sacrificial material layer in preparation for defining features into the layer by anisotropic dry etching (e.g. reactive ion etching).

Figure 3C:
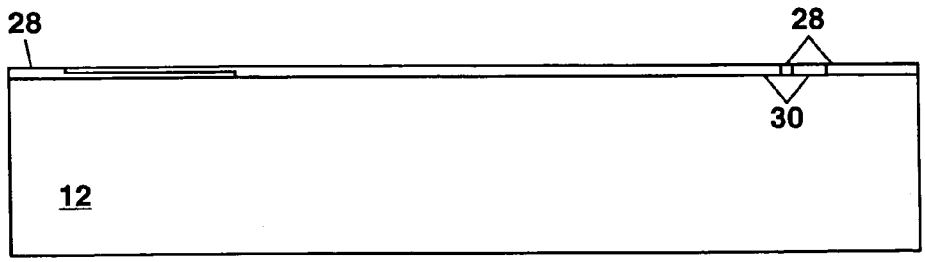

In FIG. 3C, one or more layers of polysilicon 30 can be blanket deposited over the substrate 12 to completely fill in the mold formed by the patterned sacrificial material 28. The polysilicon 30 can then be planarized by a conventional chemical-mechanical polishing step to provide a planar surface for the polysilicon 30 and the sacrificial material 28 as shown in FIG. 3C. This polishing step can also be used to precisely control and adjust the thickness of the polysilicon 30 at the locations wherein the folded springs 16 will be formed.

For this example of the present invention, each folded spring 16 comprises two pairs of spring arms, with one pair of spring arms being connected between the proof mass 14 and a crossbeam 32, and with the other pair of spring arms being connected between the crossbeam 32 and the substrate 12 as shown in FIG. 1. The polishing step allows the folded springs 16 to be precisely adjusted in thickness to provide a predetermined threshold value of the acceleration needed to activate the MEM acceleration switch 10. As an example, the thickness of the folded springs 16 in the device 10 of FIG. 1, can be 3 μm, with each spring arm having a length in the range of 300–500 μm and a width in the range of 10–30 μm. The crossbeam 32 can have the same thickness as the spring arms, and can be 20–50 μm wide and 200–500 μm long.

Figure 3D:
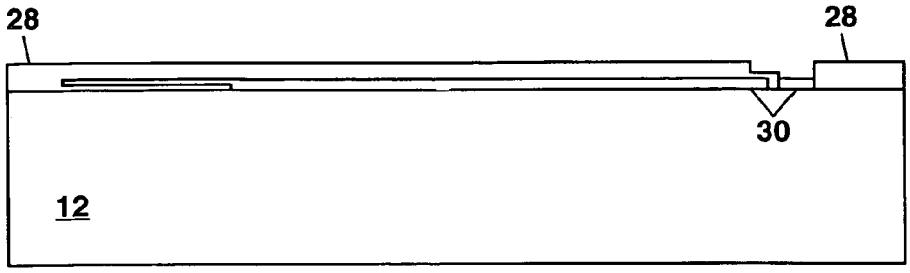

In FIG. 3D, another layer of the sacrificial material 28 can be blanket deposited over the substrate and patterned by reactive ion etching to build up the mold for defining the shape of the various elements being formed from the polysilicon 30 including the springs 16, stops 18 and a pair of supports 34 for attaching each spring 16 to the substrate 12 (see FIG. 1).

Figure 3E:
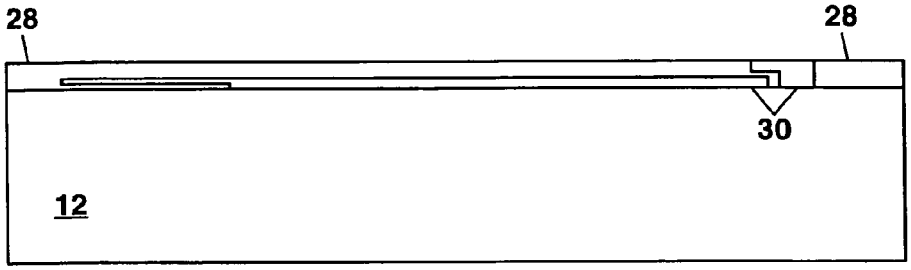

In FIG. 3E, another layer of the polysilicon 30 can be blanket deposited over the substrate 12 to fill in the mold formed from the sacrificial material 28, with any of the polysilicon 30 outside of the mold being removed by another polishing step. This process can be repeated, as needed, to build up the complete structure for the springs 16, stops 18, and spring supports 34.

Each layer of polysilicon 30 described above can be deposited at a temperature of about 580° C. using low-pressure chemical vapor deposition (LPCVD). The polysilicon 30 can be doped for electrical conductivity (e.g. with phosphorous) to about the same level as the substrate 12. This can be done either during deposition of the polysilicon 30, or subsequently thereto using an ion implantation or thermal diffusion step. Annealing of the polysilicon 30 at a high temperature (e.g. about 1100° C. for a few hours) can be used to remove or reduce any residual stress in the polysilicon 30.

Figure 3F:
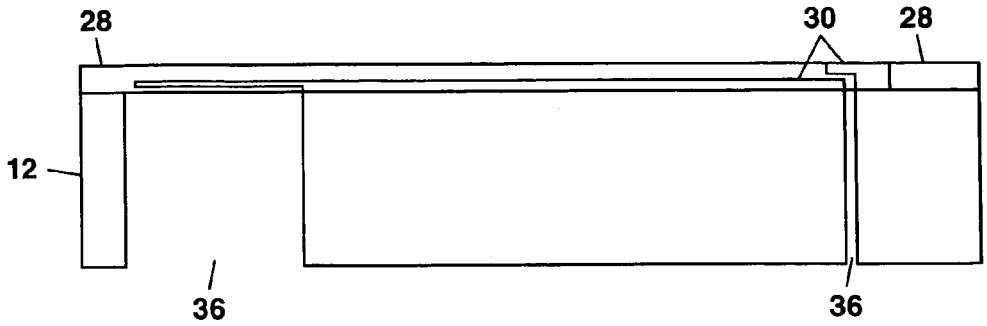

In FIG. 3F, once the structure of the springs 16, spring supports 32 and the stops 18 has been built up by surface micromachining, these elements can be left embedded in the sacrificial material 28; and processing of a backside of the substrate 12 can be performed to define the proof mass 14 which can be formed from at least partially from the substrate 12 by a deep reactive ion etching (DRIE) step. This DRIE process step can also be used to remove portions of the substrate 12 underneath the springs 16 to provide room for the springs 16 to move downward in response of an acceleration-induced movement of the proof mass 14 (see FIG. 2B).

The DRIE process is disclosed in detail in U.S. Pat. No. 5,501,893 to Laermer, which is incorporated herein by reference. Briefly, the DRIE process utilizes an iterative Inductively Coupled Plasma (ICP) deposition and etch cycle wherein a polymer etch inhibitor is conformally deposited as a film over the silicon substrate 12 during a deposition cycle and subsequently removed during an etching cycle. The polymer film, which can be formed in a $C_4F_8$/Ar-based plasma, deposits conformally over a photolithographically patterned photoresist mask (not shown) which is used to protect areas of the backside of the silicon substrate 12 not being etched and over sidewalls of a cavity 36 being etched from the backside of the silicon substrate 12 around the proof mass 14 and underneath each spring 16. The cavity 36 can be, for example, about 100 μm wide around the proof mass 14 and can be sized to be about 100 μm larger than the lateral dimensions of the springs 16.

During a subsequent etch cycle using an $SF_6$/Ar-based plasma, the polymer film is preferentially sputtered from the cavity 36 and from the top of the photoresist mask. This exposes the silicon substrate 12 in the region wherein the cavity 36 is being formed to reactive fluorine atoms from the $SF_6$/Ar-based plasma with the fluorine atoms then being responsible for etching the exposed portion of the silicon substrate 12. After the polymer at the bottom of the cavity 46 has been sputtered away and the bottom etched by the reactive fluorine atoms, but before the polymer on the sidewalls of the cavity 36 has been completely removed, the polymer deposition step using the $C_4F_8$/Ar-based plasma is repeated. This cycle continues until a desired etch depth is reached, which in the present case is completely through the thickness of the substrate 12 to the sacrificial material 28, or partway through the sacrificial material 28. Each polymer deposition and etch cycle generally lasts only for a few seconds (e.g. $\leqq$10 seconds). The net result is that features can be anisotropically etched into or completely through the silicon substrate 12 while maintaining substantially straight sidewalls (i.e. with little or no inward tapering).

The DRIE etching process can be used to form the proof mass 14 with any desired shape for the major surfaces thereof including a circular shape or a polygonal shape. These shapes for the major surfaces produce a proof mass 14 in the form of a cylinder or right polyhedron (i.e. prism), respectively. The proof mass 14 can have lateral dimensions of up to a few millimeters and will generally be about as thick as the substrate 12 (e.g. 400–600 μm) or more with the additional polysilicon 30 and metallization 22.

Figure 3G:
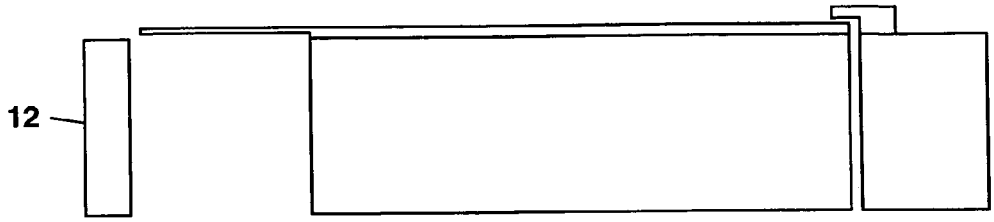

After the DRIE process step has been performed, the photoresist mask can be stripped, and the substrate 12 cleaned. The sacrificial material 28 can then be removed as shown in FIG. 3G. This can be done by immersing the substrate 12 into a selective wet etchant comprising hydrofluoric acid (HF) for up to a few hours to selectively etch away the sacrificial material 28 while not substantially chemically attacking the silicon substrate 12 or the polysilicon 30 used to form the springs 16 and other elements of the MEM acceleration switch 10.

Figure 3H:
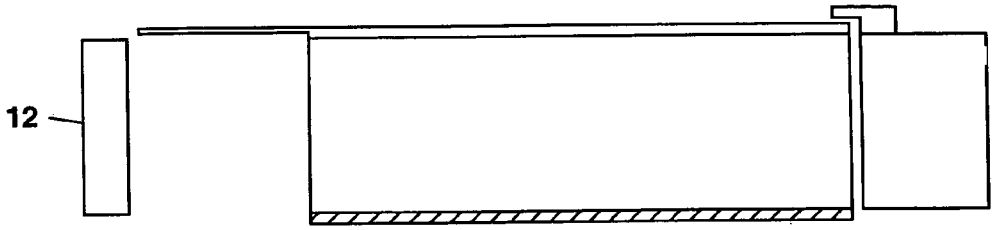

The metallization 22, which has an overall thickness of up to a few hundred nanometers, can be deposited over a lower major surface of the proof mass 14 as shown in FIG. 3H. This can be done either before or after die singulation when a plurality of MEM acceleration switches 10 are batch fabricated on a common substrate 12. The metallization 22 and the electrode 20 are preferably formed from nonoxidizable metals such as platinum and gold. The use of dissimilar metals for the metallization 22 and electrode 20 is beneficial to prevent adhesion which might otherwise result from contact between the metallization 22 and electrode 20 when a single type of metal (e.g. gold) is used for both. The adhesion of the platinum or gold can be improved by the use of a thin layer of titanium, or alternately a Ti/TiN/Ti adhesion stack which can be, for example, about 120 nanometers thick. The metallization 22 can be deposited over the lower surface of the proof mass 14 by evaporation or sputtering through a shadow mask, with an exact area of the metallization 22 depending upon the size and location of one or more electrodes 20 which must be contacted by the metallization 22 for operation of the MEM acceleration switch 10.

Figure 3I:
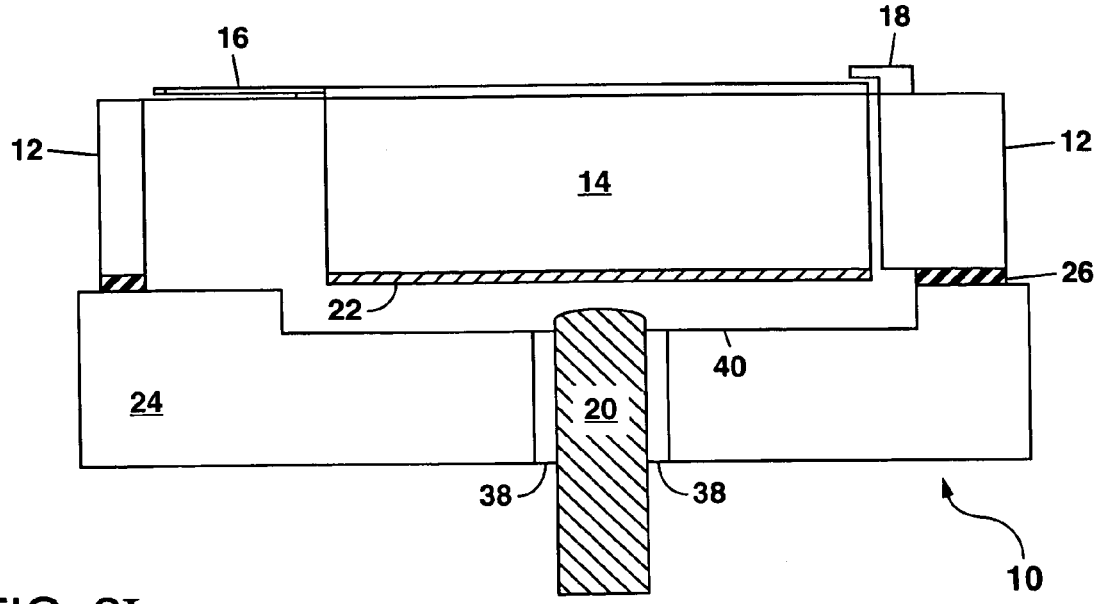

In FIG. 3I, the substrate 12 can be attached to a submount or package 24 to complete the MEM acceleration switch 10. As an example, a conventional semiconductor device header (e.g. a TO-5 or TO-18 header) can be used as a package 24 for the MEM acceleration switch 10. Such a header 24 is generally formed from metal with one or more electrodes 20 extending through the metal header and electrically isolated by an insulating material 38 (e.g. glass or ceramic) as shown in FIG. 3I. Each electrode 20 can be optionally rounded slightly as shown in FIG. 3I. Other types of semiconductor device headers comprising plastic or ceramic can also be used, in which case, an insulating material 38 is not needed for electrical isolation of the electrode(s) 20.

In FIG. 3I, the package 24 can include a recessed portion 40 to allow for movement of the proof mass 14, or alternately a spacer 60 (see FIG. 6A) can be provided between the substrate 12 and the package 24 to provide a predefined spacing between the metallization 22 and the electrode 20 when the proof mass 14 is in the rest position. This spacing can be, for example, 40 μm and will generally be in the range of 10–200 μm or more.

As described previously, the substrate 12 and the submount or package 24 can be permanently attached together with a bonding material 26 such as an adhesive (e.g. a conductive epoxy) or solder. In other embodiments of the present invention, the substrate 12 can be attached to a submount or package using diffusion bonding, low-temperature co-firing, etc. The form of attachment between the substrate 12 and the submount or package 24 will, in general, depend on the materials used for the substrate 12 and the submount or package 24, and the magnitude of the acceleration to be sensed, and cost and reliability factors. A lid (not shown) can be provided over the substrate 12 and attached to the substrate 12 or package 24 to form a hermetically-sealed device 10.

Figure 4:
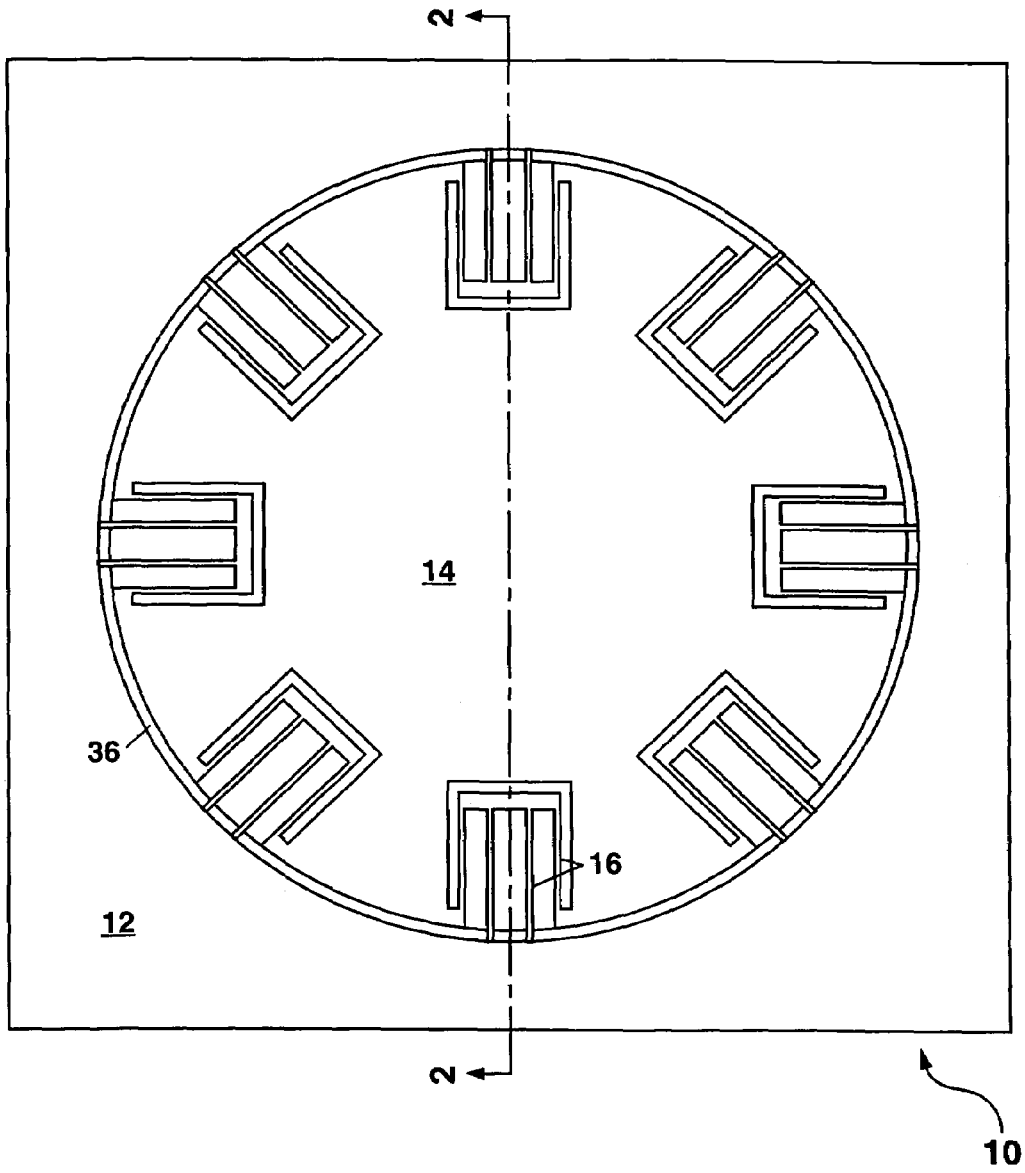
FIG. 4 shows a schematic plan view of a second example of the MEM acceleration switch of the present invention.

FIG. 4 schematically illustrates in plan view a second example of the MEM acceleration switch 10 of the present invention. In the device 10 of FIG. 4, a plurality of folded springs 16 are located within an outline of the proof mass 14 to save space. This allows the proof mass 14 to be made larger than would be the case if the springs 16 were located outside the proof mass outline as in FIG. 1 when the size of the substrate 12 is fixed, or alternately allows a smaller size substrate 12 to be used when the size of the proof mass 14 is fixed.

Figure 5:
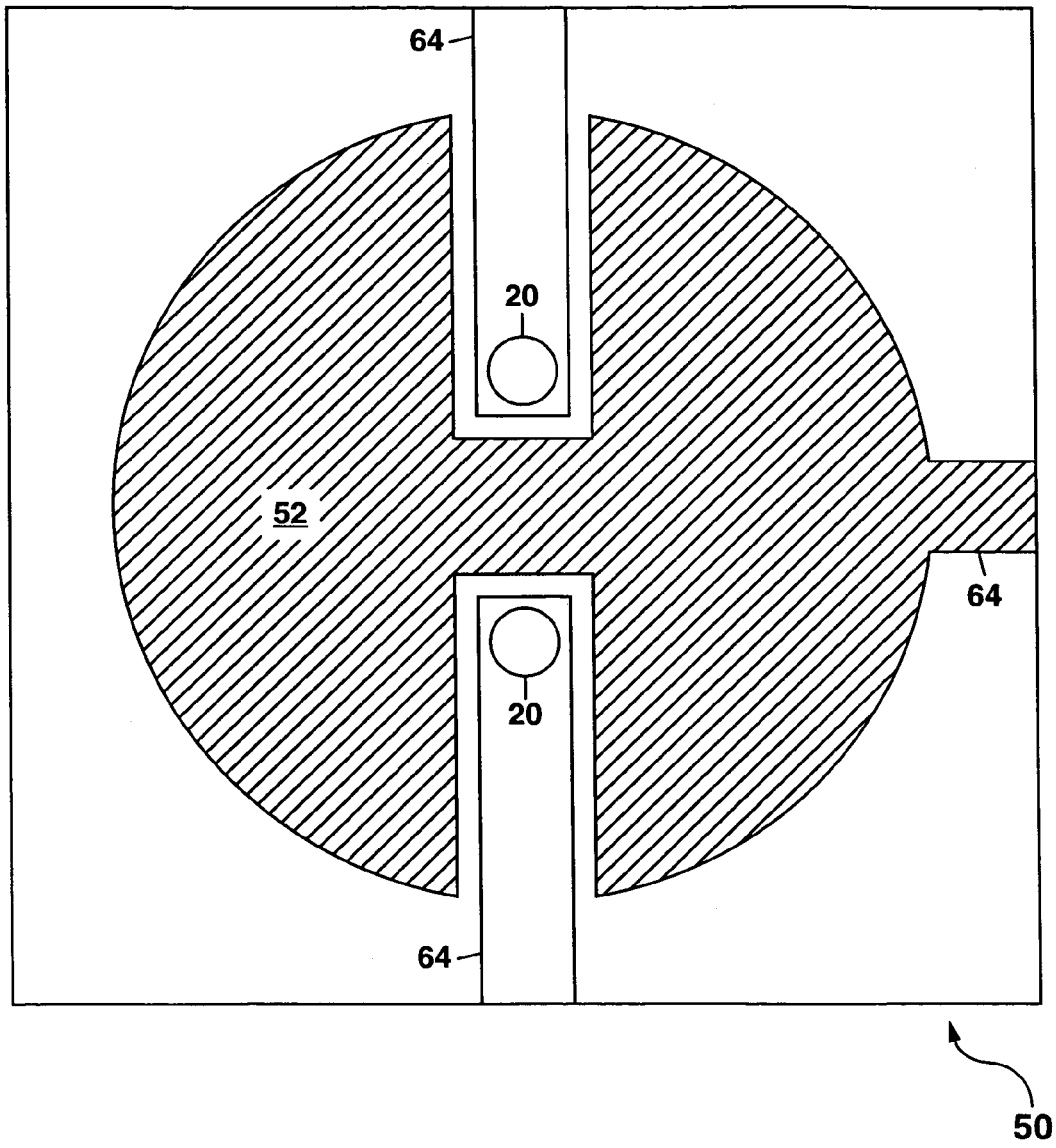
FIG. 5 shows a schematic plan view of a submount used in the device of FIG. 4.

Underlying the substrate 12 in FIG. 4 is a submount 50 which is schematically shown in plan view in FIG. 5. The submount 50, which can be the same size as the substrate 12, includes a pair of electrodes 20, which upon actuation of the device 10, electrically contact a metallization 22 located on an underside of the proof mass 14.

Figure 6A:
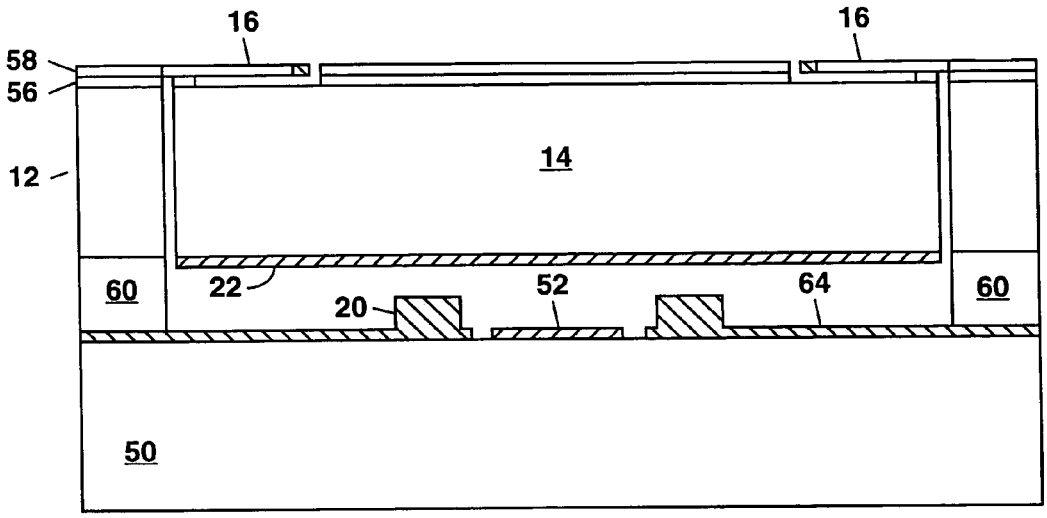
FIGS. 6A and 6B show schematic cross-section views of the device of FIG. 4 along the section line 2—2 in FIG. 4, with the device being in the rest position in FIG. 6A and in the actuated position in FIG. 6B.
Figure 6B:
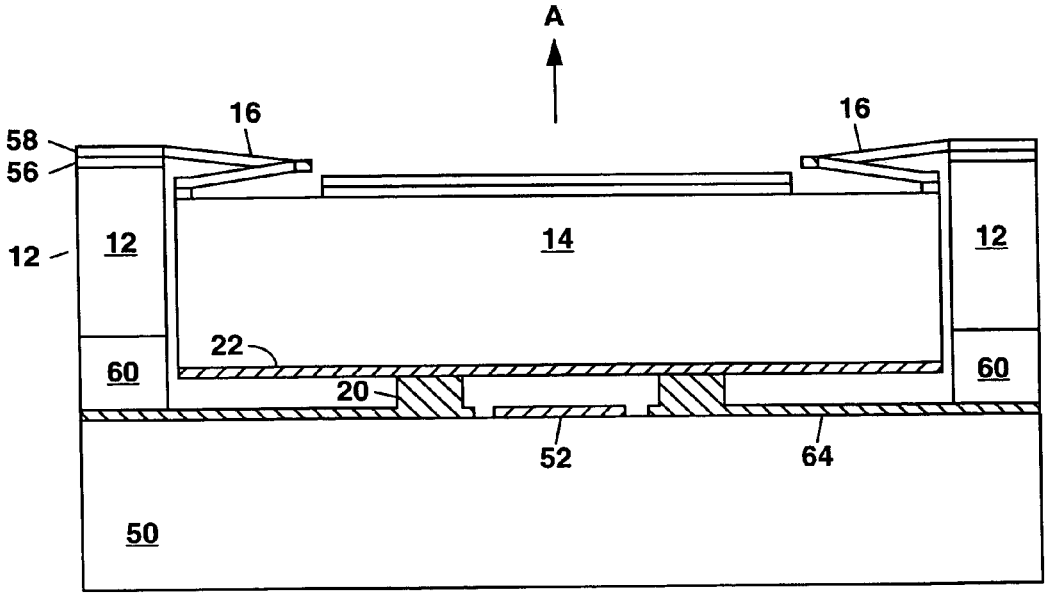

FIGS. 6A and 6B are schematic cross section views of the MEM acceleration switch 10 of FIGS. 4 and 5 taken along the section line 2—2 in FIG. 4. FIG. 6A shows the device 10 in a rest position; and FIG. 6B shows the device 10 in an actuated position in response to a sensed acceleration component A above the threshold level.

In the rest position in FIG. 6A, the proof mass 14 is suspended from the substrate 12 by a plurality of folded springs 16 which are spaced around a periphery of the rest mass 14 as shown in FIG. 4. In FIG. 6B, the device 10 is actuated by an acceleration component A which results in the proof mass 14 being urged into contact with the electrodes 20 thereby providing a switch closure which can be used to indicate the occurrence of the acceleration component A, and that the acceleration component A is above the threshold value.

It is possible to electrically latch the device 10 of FIG. 4, or any of the other examples of the MEM electrical switch 10 described herein, in a closed (i.e. actuated) position by providing a latching electrode 52 on the submount 50 or on the package 24 (e.g. by using a metal portion of the package 24 which can be electrically grounded). The latching electrode 52, which is shown in more detail in FIG. 5, can act in combination with the metallization 22 on the proof mass 14 to form an electrical latch which provides an electrostatic force of attraction that can maintain the switch 10 in the closed position after occurrence of the acceleration event above the threshold value. This can be done in several ways. For example, a relatively high resistance electrical connection can be made through the springs 16 to the proof mass 14 and metallization 22 to maintain the metallization 22 at a predetermined electrical potential (e.g. ground electrical potential). A different electrical potential can be maintained on the latching electrode 52. The electrical potentials on the electrode 52 and the metallization 22 can be selected so that an electrostatic force of attraction in the rest position is much smaller than a restoring force provided by the springs 16 so that the proof mass 14 will not be electrostatically moved downward and latched against the electrodes 20 without the occurrence of an acceleration component A of a predetermined magnitude. Once the acceleration component A is sensed by the switch 10 and the proof mass 14 is urged downward thereby, the electrostatic force of attraction, which increases as the inverse square of the distance between the metallization 22 and the latching electrode 52, will be sufficient to electrically latch the proof mass 14 in the actuated position. This electrical latching is advantageous to reduce any chatter (i.e. contact bounce) in the switch 10 due to a sudden or changing acceleration component A, and is also advantageous to maintain the switch 10 in a closed position when this is needed after the occurrence of the acceleration event.

Another way that latching of the device 10 in FIG. 4 can be performed is by utilizing an electrical potential provided by the electrodes 20 in combination with a different electrical potential on the latching electrode 52. In this mode of operation, the metallization 22 can be left floating in the rest position, or alternately connected to a ground electrical potential through a relatively high-resistance current path through the springs 16 to the substrate 12 (e.g. by using a lower doping level of for the substrate 12, springs 16 and proof mass 14). The latching electrode 52 can also be maintained at ground electrical potential. Once the acceleration component A is sensed and the proof mass 14 and metallization 22 are urged into contact with the electrodes 20, an electrical potential present on one or both of the electrodes 20 will be electrically connected to the metallization 22, and this can result in a potential difference between the metallization 22 and the latching electrode 52 which, in turn, can generate the electrostatic force of attraction needed to latch the device 10 in the closed position.

The second example of the MEM acceleration switch 10 in FIG. 4 can be fabricated as described hereinafter with reference to FIGS. 7A–7G.

Figure 7A:
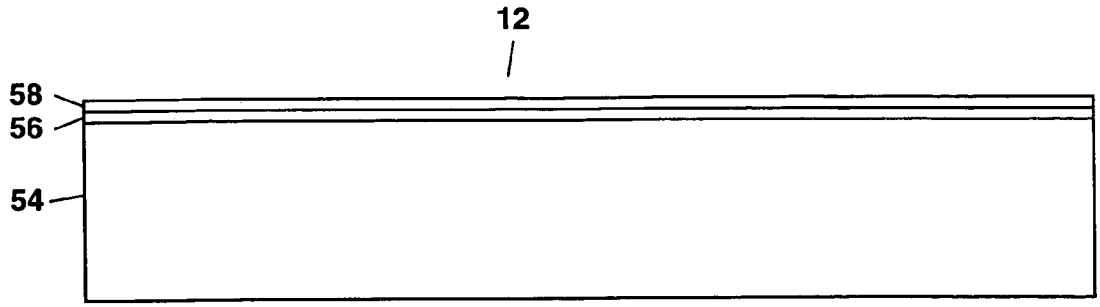
FIGS. 7A–7G show schematic cross-section views to illustrate fabrication of the device of FIG. 4.

In FIG. 7A, the starting point for fabrication of the second example of the MEM acceleration switch of FIG. 4 is a conventional silicon-on-insulator (SOI) substrate 12 which comprises a monocrystalline silicon body 54, an insulating layer 56 overlying the body 54, and a monocrystalline silicon layer 58 overlying the insulating layer 56. The monocrystalline silicon body 54 can be, for example, 400–500 μm thick, with the insulating layer 56 and the monocrystalline silicon layer 58 each being up to a few tens of microns thick (e.g. 1–50 μm). The monocrystalline silicon body 54 and the silicon layer 58 can both be doped for electrical conductivity (e.g. n-type or p-type doped to $10^{15}$–$10^{18}$ $cm^{-3}$), with an exact doping level depending upon a required electrical resistivity for the substrate 12, springs 16 and proof mass 14. The insulating layer 56 generally comprises silicon dioxide. The use of a SOI substrate 12 is advantageous in that the springs 16 can be formed without any residual stress, and since fabrication of the MEM acceleration switch 10 can be simplified.

Figure 7B:
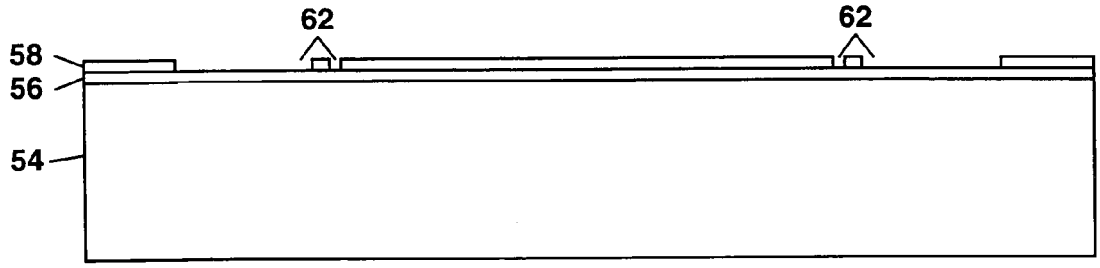

In FIG. 7B, the monocrystalline silicon layer 58 is patterned to provide a plurality of openings 62 through the layer 58 to the underlying insulating layer 56. This defines the shape of each spring 16 which will be formed from the layer 58 and also separates a portion of the layer 58 which will form a part of the proof mass 14 from another portion of the layer 58 which will remain a part of the substrate 12. The patterning of the monocrystalline silicon layer 58 can be performed by reactive ion etching using a photolithographically-defined etch mask which is not shown in FIG. 7B. Additional openings 62 can be etched through the layer 58 and through the insulating layer 56 and filled with deposited metal or polysilicon to form vias (not shown) for electrically connecting the metallization 22 to the substrate 12.

Figure 7C:
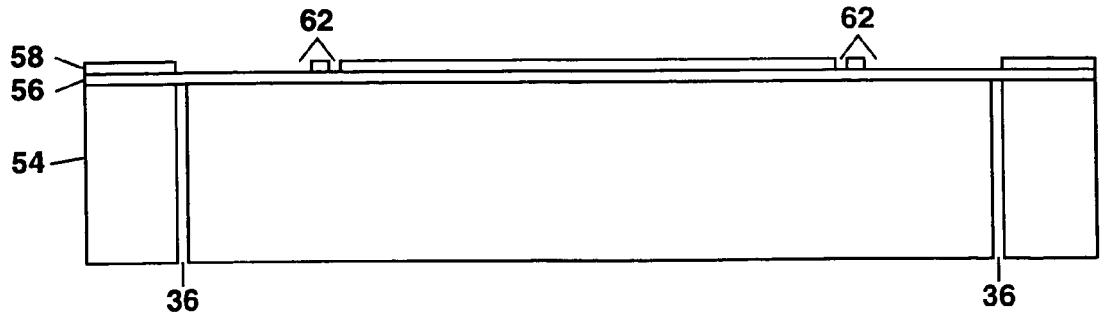

In FIG. 7C, the body 54 of the SOI substrate 12 can be patterned to provide a cavity 36 to define the shape of the proof mass 14 being formed from the substrate 12. This can be done by etching from a backside of the substrate 12 using a DRIE step as described previously with reference to FIG. 3F, with the etching being terminated upon reaching the silicon dioxide insulating layer 56. The cavity 36 can be extended to etch through the body 54 beneath each spring 16, if desired. However, this is generally not needed since the springs 16 overlie the proof mass 14 and will bend away from the proof mass 14 as the proof mass 14 is moved downward in response to a sensed acceleration. In the event of an upward movement of the proof mass 14, the springs 16 can act as stops to limit the upward movement. Additional stops 18 can also be optionally formed from the monocrystalline silicon layer 58 during patterning of the layer 58, with the stops 18 being attached to the substrate 12 and overlying the proof mass 14 as schematically illustrated in FIG. 1.

Figure 7D:
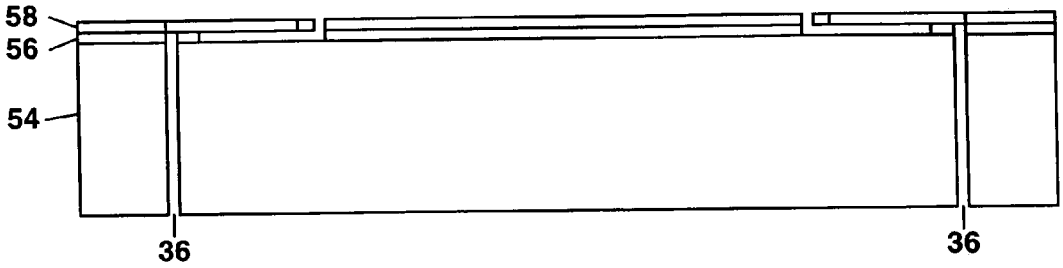

In FIG. 7D, portions of the silicon dioxide insulating layer 56 are removed underneath the springs 16 and at the locations of each cavity 36 to free up the proof mass 14 and the springs 16 for movement. This can be done using a selective wet etchant comprising HF as described previously with reference to FIG. 3G. Etching of the insulating layer 56 can be timed to completely remove the silicon dioxide underneath the springs 16 and proximate to the cavities 36, with the insulating layer 56 elsewhere being left largely intact.

Figure 7E:
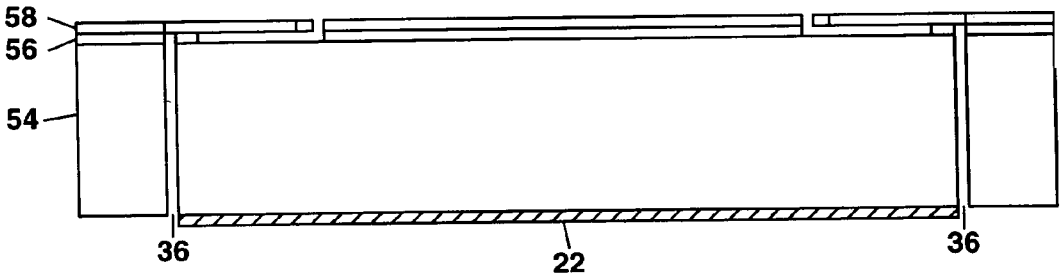

In FIG. 7E, an underside major surface of the proof mass 14 can be metallized. This can be done, for example, by evaporation or sputtering through a shadow mask as previously described with reference to FIG. 3H, with the metallization 22 comprising platinum or gold. The thickness of the metallization 22 on the underside major surface can be up to a few hundred nanometers thick, and the metallization 22 preferably covers a majority of the surface area of the underside major surface.

Figure 7F:
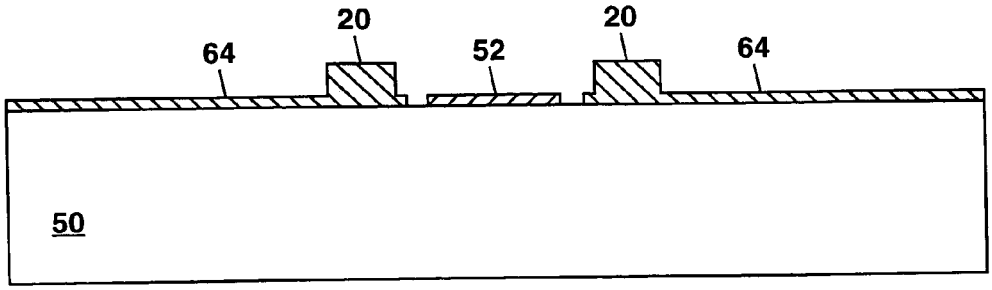

In FIG. 7F, the submount 50 can be metallized to form the electrodes 20 and 52 thereon, and also to form electrical wiring 64 for connecting the electrodes 20 and 52 to contact pads (not shown). The submount 50 can comprise, for example, a ceramic, substrate having a thickness of about 0.5–1 millimeter, with lateral dimensions of the submount 50 being the same or larger than the lateral dimensions of the silicon substrate 12. A few hundred nanometers thickness of metal (e.g. gold) can be deposited on the submount 50 by evaporation or sputtering to form the electrical wiring 64 and the latching electrode 52. The electrodes 20 can comprise additional metal which is built up on the submount 50 to a predetermined height (e.g. 60 μm). This can be done, for example, by a coining process whereby a quantity of gold is ball-bonded or bump-bonded onto the electrical wiring 64 at the location where the electrodes 20 are to be formed. The bonded gold can then being coined (i.e. stamped or molded) into shape to provide a precise height for each electrode 20. Alternately, the electrodes 20 can be formed by electroplating after providing a mask over the submount 50 with openings at the locations where the electrodes 20 are to be formed. When the metallization 22 comprises gold, the electrodes 20 or the metallization 22 can be optionally coated with a layer of TiN on the order of 100 nanometers thick to mitigate any gold—gold microwelding upon contacting of the metallization 22 with the electrodes 20.

Figure 7G:
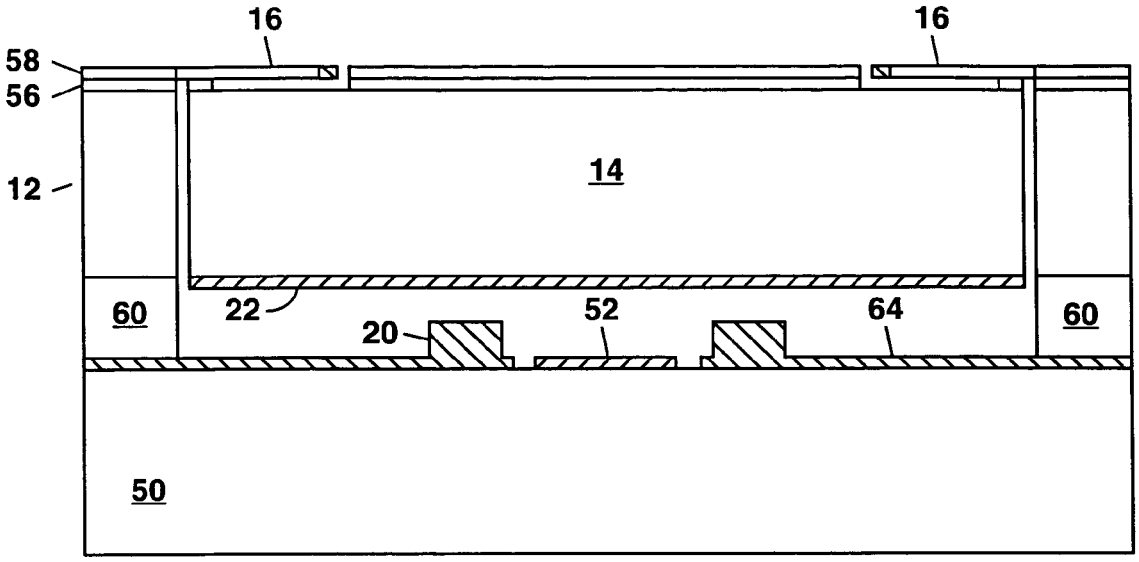

In FIG. 7G, the substrate 12 can be attached to the submount 50 using an intervening spacer 60 which can comprise an electrically-insulating material such as a ceramic. The spacer 60 preferably has a thickness which provides a predetermined spacing between the metallization 22 and the electrodes 20. This spacing can be, for example, in the range of 20–200 μm. An opening 66 is provided through the spacer 60 centered about the proof mass 14 to allow for movement of the proof mass 14. The opening 66 can be formed, for example, by laser machining. The substrate 12, spacer 60 and submount 50 can all be permanently bonded together to form the completed MEM acceleration switch 10 which can be packaged in a hermetically-sealed conventional semiconductor header package, or in a low-temperature co-fired ceramic (LTCC) package. Bonding of the substrate 12, spacer 60 and submount 50 can be performed using an adhesive (e.g. epoxy) or by LTCC processing as known to the art. When LTCC processing is used, a ceramic seal ring can be provided to bond a ceramic cover onto the submount 50 to package the MEM acceleration switch 10.

Figure 8:
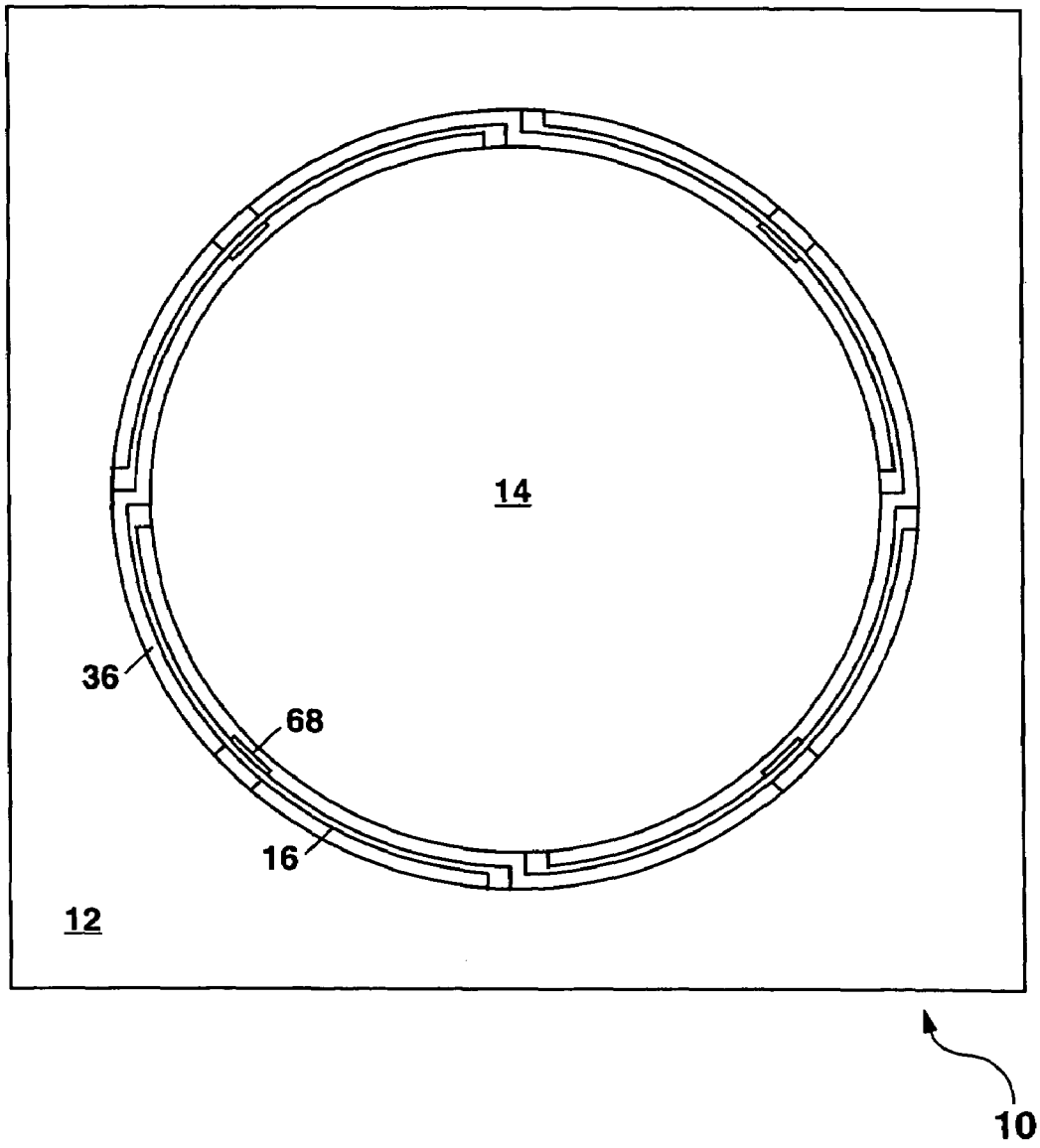
FIG. 8 shows a schematic plan view of a third example of the MEM acceleration switch of the present invention.

FIG. 8 schematically illustrates in plan view a third example of a MEM acceleration switch 10 according to the present invention. The device 10 of FIG. 8 utilizes a plurality of arcuate springs 16 to suspend the proof mass 14 from the substrate 12, with each spring 16 being attached at one end thereof to the substrate 12 and at the other end thereof to the proof mass 14. The arcuate springs 16 are preferably made much stiffer in a lateral direction in the plane of the substrate 12 than in a vertical direction perpendicular to the plane of the substrate 12. The stiffness of the arcuate springs 16 in the lateral direction, however, is much smaller than that of the devices of FIGS. 1 and 4 which utilize folded springs 16. A very large acceleration component (e.g. due to shock) in the devices of FIGS. 1 and 4 can lead to a buckling (i.e. breaking) of the folded springs 16; whereas the arcuate springs 16 in the example of FIG. 8 are able to bend laterally so that they are much less susceptible to breaking. This in-plane movement allowed by the arcuate springs 16 in the example of FIG. 8 will not result in actuation of the MEM acceleration switch 10, but is merely provided to mitigate the possibility for breakage of the springs 16. A plurality of lateral stops 68 can also be provided in the device 10 of FIG. 8 to limit an extent of the lateral movement of the proof mass 14 so that the proof mass 14 does not bang against the arcuate springs 16 when a large lateral acceleration component is experienced. The lateral stops 68 can extend outward from a sidewall of the cavity 36 as shown in FIG. 8, with the lateral stops 68 being formed during one or more DRIE steps used to form the cavity 36 so that the lateral stops 68 extend partway or entirely through the thickness of the monocrystalline silicon body 54.

The device 10 of FIG. 8 can be fabricated as previously described with reference to FIGS. 3A–3I with the springs 16 being formed of polysilicon, or as previously described with reference to FIGS. 7A–7G with the springs 16 being formed of monocrystalline silicon. Operation of this example of the MEM acceleration switch 10 is similar to that described previously for the first and second examples of the switch 10, with the proof mass 14 being urged downward in response to an acceleration component A of a predetermined magnitude in a direction substantially perpendicular to the plane of the substrate 12. When the acceleration exceeds a predetermined threshold value, a metallization 22 located on an underside of the proof mass 14 will contact one or more electrodes 20 and result in a switch closure.

The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A microelectromechanical (MEM) acceleration switch, comprising:

(a) a substrate;

(b) a proof mass flexibly connected to the substrate by a plurality of folded springs located around an outer periphery of the proof mass, with the proof mass being moveable in a direction substantially perpendicular to the substrate in response to a sensed acceleration, and further comprising a first electrode located on a major surface of the proof mass; and (c) a second electrode located proximate to the first electrode to provide an electrical connection thereto upon movement of the first electrode into contact with the second electrode in response to the sensed acceleration.

2. The MEM acceleration switch of claim 1 wherein the substrate comprises silicon.

3. The MEM acceleration switch of claim 2 wherein the proof mass comprises silicon.

4. The MEM acceleration switch of claim 3 wherein each folded spring comprises monocrystalline silicon.

5. The MEM acceleration switch of claim 3 wherein each folded spring comprises polycrystalline silicon.

6. The MEM acceleration switch of claim 1 wherein the proof mass has a thickness equal to or greater than the thickness of the substrate.

7. The MEM acceleration switch of claim 1 wherein the major surface of the proof mass has a shape that is circular or polygonal.

8. The MEM acceleration switch of claim 1 wherein the plurality of folded springs comprises three to sixteen folded springs.

9. The MEM acceleration switch of claim 1 wherein each folded spring comprises a first pair of spring arms connected to the proof mass, and a second pair of spring arms connected to the substrate, with the first and second pairs of spring arms being connected together by a crossbeam.

10. The MEM acceleration switch of claim 1 wherein each folded spring in the plurality of folded springs has a thickness in the range of 1–50 microns.

11. The MEM acceleration switch of claim 1 wherein the first electrode is electrically connected to the substrate through the proof mass and the plurality of folded springs.

12. The MEM acceleration switch of claim 1 further comprising at least one stop on the substrate extending over the periphery of the proof mass to limit movement of the proof mass in a direction away from the second electrode.

13. The MEM acceleration switch of claim 1 further comprising an electrical latch to maintain the electrical connection between the first and second electrodes after the sensed acceleration has occurred.

14. A microelectromechanical (MEM) acceleration switch, comprising:

(a) a substrate;

(b) a proof mass flexibly connected to the substrate by a plurality of folded springs located around a periphery of the proof mass, with the proof mass being moveable in a direction substantially perpendicular to the substrate in response to a sensed acceleration, and further comprising a first electrode located on a major surface of the proof mass; and (c) a second electrode located on a submount whereon the substrate is attached with the second electrode being proximate to the first electrode to provide an electrical connection thereto upon movement of the first electrode into contact with the second electrode in response to the sensed acceleration.

15. The MEM acceleration switch of claim 14 further comprising a third electrode located on the submount, with the first electrode upon contact with the second and third electrodes providing an electrical connection between the second and third electrodes.

16. A microelectromechanical (MEM) acceleration switch, comprising:

(a) a substrate;

(b) a proof mass flexibly connected to the substrate by a plurality of folded springs located around a periphery of the proof mass, with the proof mass being moveable in a direction substantially perpendicular to the substrate in response to a sensed acceleration, and further comprising a first electrode located on a major surface of the proof mass; and (c) a second electrode comprising a pin of a package whereon the substrate is attached with the second electrode being located proximate to the first electrode to provide an electrical connection thereto upon movement of the first electrode into contact with the second electrode in response to the sensed acceleration.

17. A microelectromechanical (MEM) acceleration switch, comprising:

(a) a substrate;

(b) a proof mass flexibly anchored to the substrate by a plurality of folded springs located around an outer periphery of the proof mass, with the proof mass being moveable in a direction substantially perpendicular the substrate, and with the proof mass having a metallization covering at least a portion of a major surface thereof; and (c) at least one electrode located proximate to the metallization to form an electrical contact therewith upon movement of the proof mass in response to an acceleration event above a threshold value.

18. The MEM acceleration switch of claim 17 wherein the substrate and the proof mass each comprise silicon.

19. The MEM acceleration switch of claim 17 wherein the major surface of the proof mass has a shape that is circular or polygonal.

20. The MEM acceleration switch of claim 17 wherein the plurality of folded springs comprises three to sixteen folded springs.

21. The MEM acceleration switch of claim 17 wherein each folded spring comprises a first pair of spring arms connected to the proof mass, and a second pair of spring arms connected to the substrate, with the first and second pairs of spring arms being connected together by a crossbeam.

22. The MEM acceleration switch of claim 17 wherein each folded spring in the plurality of folded springs has a thickness in the range of 1–50 microns.

23. The MEM acceleration switch of claim 17 further comprising an electrical latch to maintain the electrical contact after occurrence of the acceleration event.

24. A microelectromechanical (MEM) acceleration switch, comprising:

(a) a substrate;

(b) a proof mass flexibly anchored to the substrate by a plurality of folded springs located around a periphery of the proof mass, with the proof mass being moveable in a direction substantially perpendicular the substrate, and with the proof mass having a metallization covering at least a portion of a major surface thereof; and (c) at least one electrode located on a submount or package whereon the substrate is attached with the at least one electrode being located proximate to the metallization to form an electrical contact therewith upon movement of the proof mass in response to an acceleration event above a threshold value.

25. A microelectromechanical (MEM) acceleration switch, comprising:

(a) a substrate;

(b) a proof mass formed, at least in part from the substrate, with the proof mass being attached to the substrate by three to sixteen springs located around an outer periphery of the proof mass, and with the proof mass having a metallization covering a majority of a major surface thereof and forming a first electrode; and (c) a second electrode located beneath the proof mass, with the first and second electrodes being spaced apart when the proof mass is in a rest position, and with the first and second electrodes being electrically connected together when the proof mass is urged into contact with the second electrode in response to an acceleration event directed substantially perpendicular to a plane of the substrate and above a threshold value.

26. The MEM acceleration switch of claim 25 further comprising a third electrode located beneath the proof mass, with the third electrode being spaced apart from the first and second electrodes when the proof mass is in the rest position, and with the third electrode being electrically connected to the first and second electrodes when the proof mass is urged into contact with the second and third electrodes in response to the acceleration event directed substantially perpendicular to a plane of the substrate and above the threshold value.

27. The MEM acceleration switch of claim 26 wherein the second and third electrodes are located on a submount or package whereon the substrate is attached.

28. The MEM acceleration switch of claim 25 wherein the substrate comprises silicon.

29. The MEM acceleration switch of claim 25 wherein each spring comprises a folded spring.

30. The MEM acceleration switch of claim 25 wherein each spring comprises an arcuate spring.

31. The MEM acceleration switch of claim 25 wherein each spring has a thickness in the range of 1–50 microns.

32. The MEM acceleration switch of claim 25 further comprising an electrical latch to maintain an electrical connection between the first and second electrodes after occurrence of the acceleration event.

33. A microelectromechanical (MEM) acceleration switch, comprising:

(a) a substrate;

(b) a proof mass formed at least in part from the substrate and attached to the substrate by a plurality of arcuate springs located around an outer periphery of the proof mass, with the proof mass forming a first electrode; and (c) a second electrode located beneath the proof mass, with the first and second electrodes being spaced apart when the proof mass is in a rest position, and being electrically connected together when the proof mass is urged into contact with the second electrode in response to an acceleration event directed substantially perpendicular to a plane of the substrate and above a threshold value.

34. The MEM acceleration switch of claim 33 further comprising an electrical latch to maintain an electrical connection between the first and second electrodes after occurrence of the acceleration event.

35. The MEM acceleration switch of claim 33 further comprising a plurality of lateral stops to limit movement of the proof mass in the plane of the substrate.

* * * * *